US005560483A

United States Patent [19]

Sequin

[11] Patent Number: 5,560,483

[45] Date of Patent: Oct. 1, 1996

[54] CLOTHING ACCESSORIES CASE

[76] Inventor: Dennis A. Sequin, 1754 N. Greenfield Cir., NE. Apt. 102, Grand Rapids, Mich. 49505

[21] Appl. No.: 335,330

[22] Filed: Nov. 7, 1994

[51] Int. Cl.[6] ..... A45C 5/12; A45C 13/02

[52] U.S. Cl. ..... 206/278; 190/109; 206/293; 220/531

[58] Field of Search ..... 206/278, 292, 206/293, 39, 295; 190/109; 220/531

[56] References Cited

U.S. PATENT DOCUMENTS

| | | | |
|---|---|---|---|
| 110,870 | 1/1871 | Roberts . | |
| 378,224 | 2/1888 | Uhrig | 206/45.14 |
| 386,807 | 7/1888 | Fleisch . | |
| 558,432 | 4/1896 | Sonn . | |
| 848,431 | 3/1907 | Blumberg . | |
| 862,154 | 8/1907 | Greenawalt | 206/292 X |
| 887,108 | 5/1908 | Matson | 206/292 |
| 1,191,007 | 7/1916 | Kassel | 206/292 |
| 1,247,539 | 11/1917 | Johnson | 206/292 |
| 1,432,457 | 10/1922 | Goodman | 206/293 X |
| 1,456,613 | 5/1923 | Bartels . | |
| 1,487,116 | 3/1924 | Maher | 206/292 |
| 1,888,301 | 11/1932 | Waller . | |
| 2,081,002 | 5/1937 | Curtis | 206/293 |
| 2,082,011 | 6/1937 | Lee | 206/293 |
| 2,259,045 | 10/1941 | Powell | 206/292 X |
| 2,331,493 | 10/1943 | Muhlhauser | 206/278 X |
| 2,446,773 | 8/1948 | Abbe | 206/292 X |
| 2,581,099 | 1/1952 | Guffey | 206/293 |
| 2,612,257 | 9/1952 | Baur | 206/292 |
| 3,595,433 | 7/1971 | Jones et al. | 206/425 X |
| 4,375,263 | 3/1983 | Dworkin | 206/425 |
| 5,195,620 | 3/1993 | Tate | 206/292 X |
| 5,249,668 | 10/1993 | Fenton et al. | 206/278 X |

FOREIGN PATENT DOCUMENTS

| | | | |
|---|---|---|---|
| 568970 | 11/1993 | European Pat. Off. | 206/278 |
| 552192 | 4/1923 | France . | |
| 471914 | 4/1927 | Germany | 206/39 |
| 3235031 | 3/1984 | Germany . | |
| 248439 | 5/1926 | Italy | 206/293 |
| 1557098 | 4/1990 | U.S.S.R. | 206/278 |
| 730718 | 5/1955 | United Kingdom | 206/293 |

*Primary Examiner*—Sue A. Weaver

*Attorney, Agent, or Firm*—Price, Heneveld, Cooper, DeWitt & Litton

[57] ABSTRACT

A clothing accessories case has a bottom portion with an interior cavity, a cooperating top portion, and a plurality of flexible dividers. The cooperating top portion abuts the bottom portion to define a closed case that encloses the interior cavity. The plurality of flexible dividers are located in the interior cavity and are oriented generally parallel with one another. The dividers are resilient to be deflected from an initial position and returned to the initial position. Each divider of the plurality of dividers is hingedly connected with the bottom portion. The interior cavity has a length and the dividers extend generally along at least a portion of the length. Each divider may include a structural substrate and a finish covering attached to and substantially encapsulating the structural substrate. Further, the finish covering may extend significantly beyond the structural substrate in at least one direction. The case may include a seal interposed between the bottom portion and the top portion to provide air-tight closure of the interior cavity. The case provides a non-wrinkling environment for one to transport one's ties or scarves and the like. The case may be used by individuals in personal travel and by manufacturers in commercial shipping of ties or scarves or the like.

23 Claims, 3 Drawing Sheets

CLOTHING ACCESSORIES CASE

BACKGROUND OF THE INVENTION

The invention relates to cases for transporting clothing accessories and is particularly useful for wrinkle-free transport of ties and scarves and the like.

Many people travel for various reasons, including business, which may require the transport of ties and scarves and the like as a part of their traveling wardrobe. Also, in the business of manufacturing and selling ties and scarves, the product needs to be shipped from the manufacturer to the ultimate reseller to the customer. In either case, it is desirable to transport ties and scarves without creating creases and wrinkles in the tie or scarf, or otherwise crumpling the merchandise.

In the case of the individual traveler, virtually everyone has his or her own method of packing ties and scarves to minimize their crumpling and creating wrinkles. By the end of one's trip, the ties or scarves are inevitably wrinkled or otherwise misshapened and ruined or in need of professional pressing.

In the case of commercial shipping, large quantities of ties or scarves are customarily packed into large cartons. Such packing may result in the product on the bottom of the carton being crushed under the weight of the product on top of it. Also, rough handling of the cartons may easily result in shifting and crumpling of the merchandise.

Thus, in each context of the individual traveler and of the commercial shipper, it is readily apparent that there is a need for improved packing and packaging of ties and scarves and the like.

SUMMARY OF THE INVENTION

Accordingly, the invention provides a clothing accessories case with a bottom portion that has an interior cavity, a cooperating top portion, and a plurality of flexible dividers that are located in the interior cavity. The interior cavity is accessible from outside the bottom portion and the cooperating top portion abuts the bottom portion to define a closed case that encloses the interior cavity. The plurality of dividers are oriented generally parallel with one another.

In one aspect of the invention, the dividers are resilient to be deflected from an initial position and return to the initial position. Further, the dividers are hingedly connected with the bottom portion. Further, each divider may include a structural substrate and a finish covering that is attached to and substantially encapsulates the structural substrate. The finish cover may extend significantly beyond the structural substrate in at least one direction. Further, the interior cavity has a length and each divider of the plurality of dividers extends generally along at least a portion of the length.

In another aspect of the invention, a seal may be interposed between the bottom portion and the top portion. The seal may be provided to provide an air-tight closure of the interior cavity.

These and other features, objects, and benefits of the invention will be recognized by those who practice the invention and by those skilled in the art, from the specification, the claims, and the drawing figures.

DESCRIPTION OF THE PREFERRED EMBODIMENTS

Figure 1:
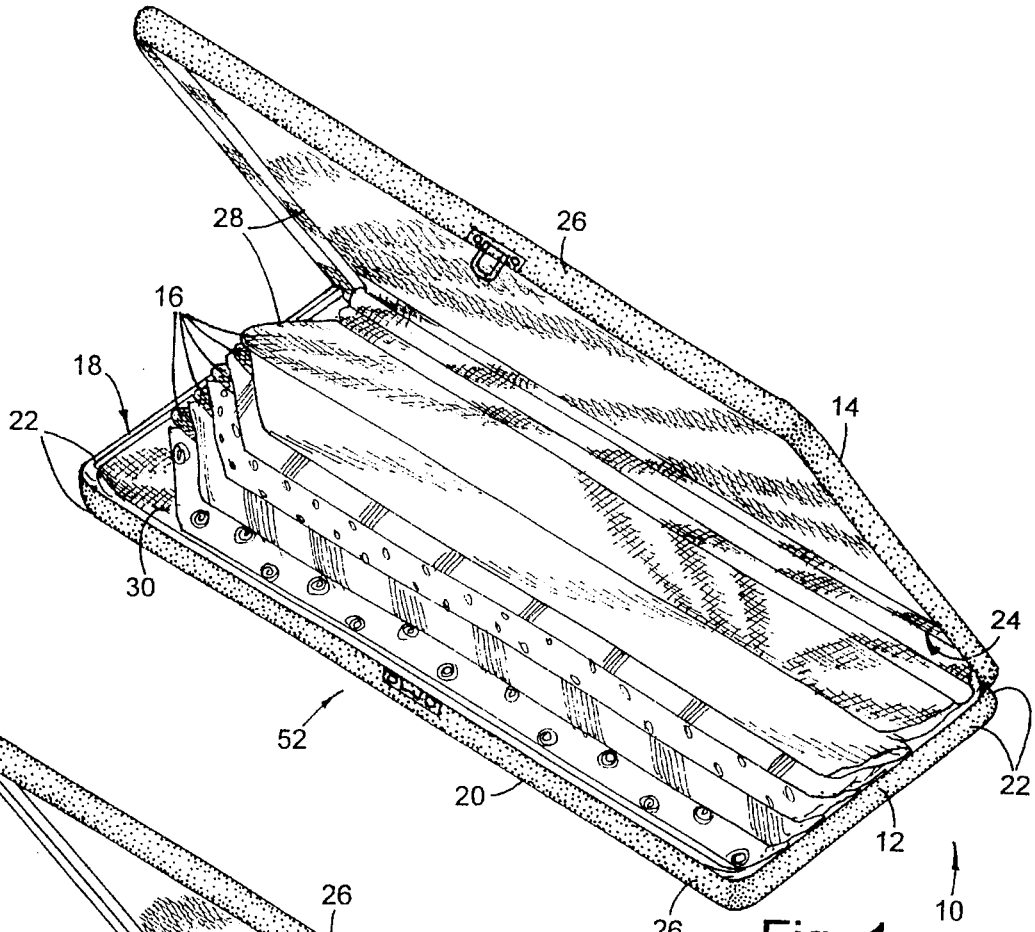
FIG. 1 is a perspective view of a clothing accessories case according to the invention, shown in a open position and containing ties.
Figure 2:
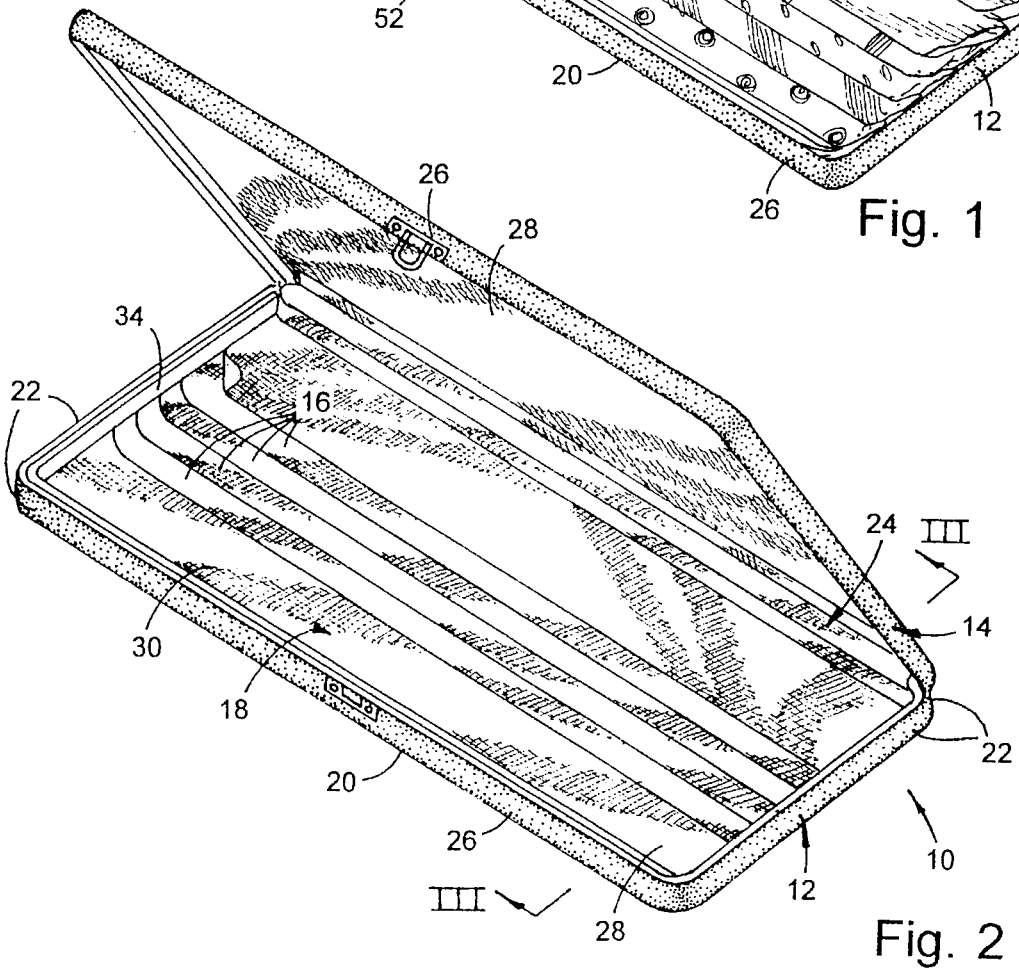
FIG. 2 is a view of FIG. 1 showing the case empty.

A clothing accessories case according to the invention is generally shown in drawing FIGS. 1 and 2 and identified by reference number 10. The case 10 that is specifically shown is a tie case and includes a bottom portion 12, a cooperating top potion 14, and a plurality of flexible dividers 16.

The bottom portion 12 (FIGS. 1, 2, and 7) has an interior cavity 18 that is accessible from outside the bottom potion 12. More particularly, the bottom portion 12 is most preferably configured as a fairly rigid, open top box that has a bottom panel 20 and four perimeter sidewalls 22. The bottom portion 12 may be made of any suitable box construction, including such materials as wood, metal, and plastic, for example. The bottom potion 12 is conveniently made as an about 2.54 mm to about 3.18 mm (about 0.100 to about 0.125 inches) thick molding of high impact polystyrene for example.

Figure 7:
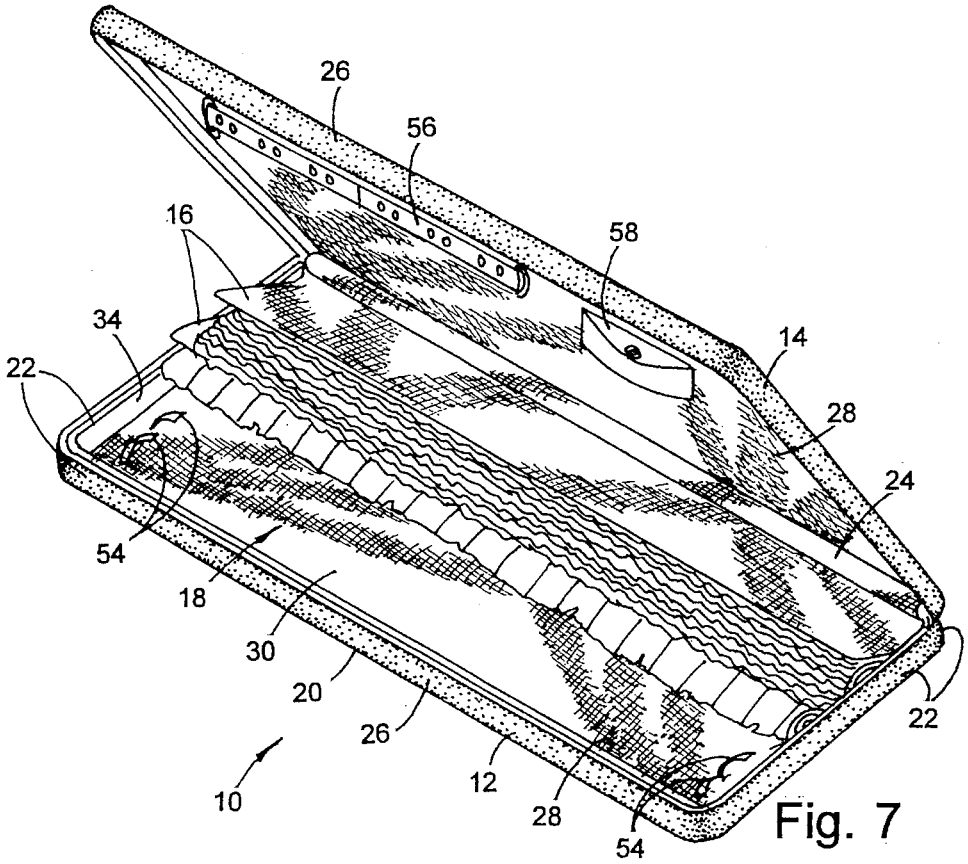
FIG. 7 is the view of FIG. 1 showing an alternative embodiment clothing accessories case.

Provided that the bottom portion 12 is configured with a deep enough interior cavity 18 or conversely that the sidewalls 22 are tall enough, the cooperating top portion 14 may be a panel member that abuts the tops of the sidewalls 22 of the bottom portion 12 to close the open top of the bottom portion 12 and define a closed case 10 that encloses the interior cavity 18. Alternatively, the top portion 14 may be identical to the bottom potion 12, which may eliminate an additional inventory item in manufacturing (FIGS. 1, 2, and 7). For an individual's traveling tie case 10 using identical top and bottom portions 12 and 14, each of the top and bottom portions 12 and 14 may be about 394 mm (about 15.5 inches) long, about 160 mm (about 6.3 inches) wide, and about 18 mm (about 0.7 inches) deep in outside dimensions, for example.

The bottom portion 12 and the top portion 14 are preferably hinged together along corresponding longitudinal edges at 24 (FIGS. 1, 2, and 7). The hinge may be a pair of spaced apart hinges, a singular piano-type hinge, a flexible member, or an interconnecting living hinge originally integrally formed with the bottom and top portions 12 and 14, for example. The particular hinge arrangement employed is not crucial to the invention and will be dictated by the specific intended use of the case 10 and the associated desires of the user.

Depending on the basic materials used for the case 10, the desired appearance of the case 10, and the intended use of the case 10, each of the bottom portion 12 and the top portion 14 may be covered with a protective or decorative covering 26, including upholstery or home furnishing fabrics and leather, as are commonly commercially available (FIGS. 1, 2, and 7). The covering 26, as desired, may be conveniently applied by use of one of the various spray adhesives that are commonly available. The interior of the top portion 14 may likewise be covered with a suitable protective or decorative covering 28. The interior covering 28 is preferably selected with qualities for protecting the contents of the case 10, including, but not limited to, minimizing potential sliding of the contents.

The interior of the bottom portion 12 is preferably covered or finished off with a divider insert 30 (FIGS. 1–3, 6, and 7). The divider insert 30 is conveniently fabricated of about 0.75 to about 1.0 mm (about 0.030 to about 0.040 inches) thick chipboard or the like. The divider insert 30 may be fabricated from a panel member having a central rectangular portion 32 that is about 381 mm (about 15 inches) long and about 147 mm (about 5.8 inches) wide, with an about 10 mm (about 0.4 inch) wide hingable tab 34 extending outward from each edge of the central rectangular portion 32. The central rectangular portion 32 of the divider insert 30 is provided with an array of slots 36 in a three-by-five matrix as is generally shown in drawing FIG. 6.

The divider insert 30 carries the dividers 16 which position, separate, and protect the ties that are carried in the tie case 10 (FIGS. 1–7). For the individual travel tie case 10 specifically being described, preferably no more than five dividers 16 will be provided. Each divider 16 is preferably constructed by laminating two sides of a resiliently flexible structural substrate 40 with the protective fabric 28, such as Beechwood Hallmark 100% cotton broadcloth No. 1839562 that is marketed by the Beechwood Company through various vendors, for example, that will protect the ties being transported. The fabric 28 may be strictly form fitting and wrap tightly around a terminal end 42 of substrate 40. The fabric 28 may also be more generously sized, so a folded flap of fabric 28 extends significantly beyond the terminal end 42 of substrate 40, but most preferable extend no farther than to the side of the case 10 as illustrated in FIG. 4A.

Figure 3:
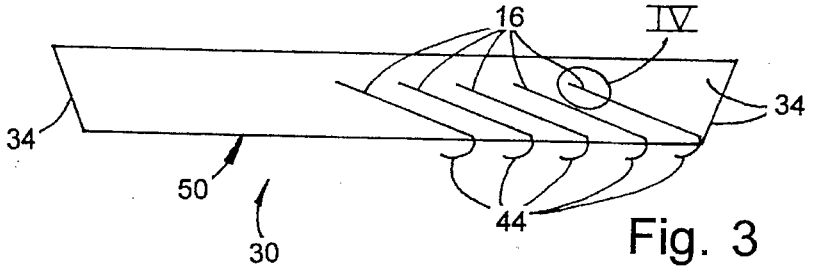
FIG. 3 is a fragmentary cross-sectional view along section line 111—111 of FIG. 2, showing a divider insert.
Figure 4:
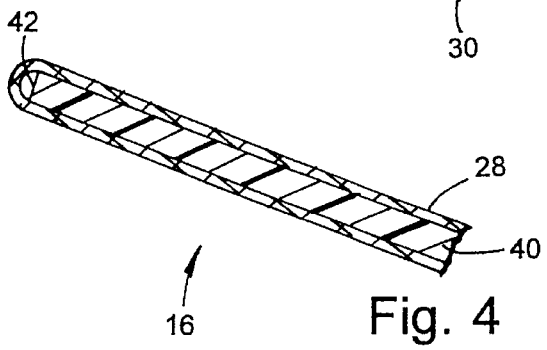
FIG. 4 is an enlarged fragmentary view of the detail IV of FIG. 3.
Figure 4A:
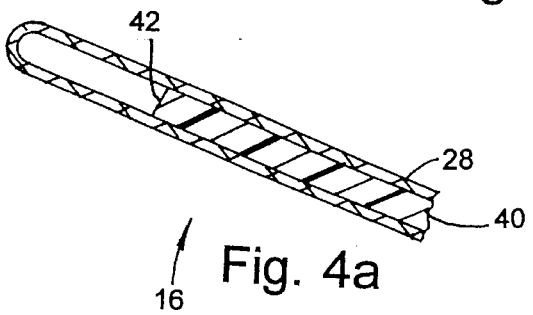
FIG. 4A is an enlarged fragmentary view of an alternate embodiment of a divider corresponding to the detail IV of FIG. 3.
Figure 5:
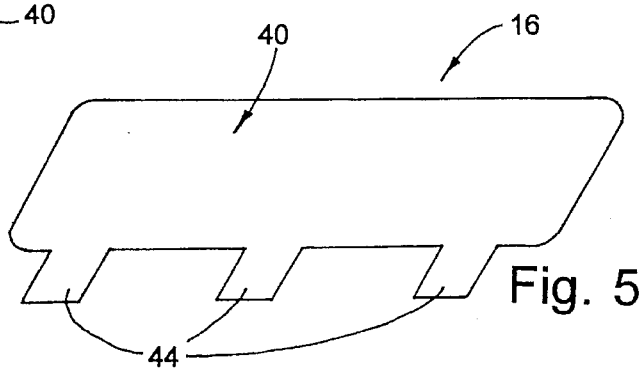
FIG. 5 is a perspective view of a divider structural substrate.
Figure 6:
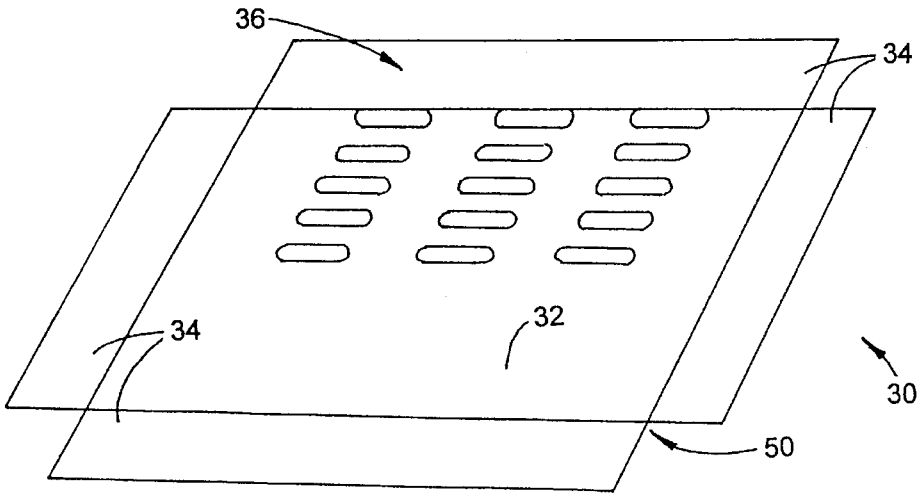
FIG. 6 is a perspective view of a divider tray support structure prior to assembly.

The structural substrate 40 may be provided by a half mil thick vinyl sheet material that is cut to an about 77 mm (about 3 inches) wide and about 375 mm (about 14.75 inches) long rectangle with rounded corners and a series of three equally spaced tabs 44 that extend about 10 mm (about 0.4 inch) from one of the two long edges of the substrate 40 (FIGS. 3–5). A single piece of protective material 28 is most preferably adhered to the two opposing side surfaces of the substrate 40. The material 28 may be conveniently adhered to the substrate 40 by use of one of the various spray adhesives that are commonly available. Alternately, this assembly may be facilitated by the use of a double faced tape, such as the Avery™ Fast-Tape(B), half mil polyester rub tape or the polyester acrylic based adhesive tape No. 591 or No. 593 by Anchor Industries, or the like, as the substrate 40.

For another alternative, one may find that laminating two layers of the protective fabric 28 together with an adhesive, without an intermediate structural substrate 40, to perform satisfactorily. Depending upon the particular laminating adhesive used, one may find that coating one or coating both of the fabric surfaces to be laminated together is required. In this instance, the structure of the two layers of fabric 28 combine with the added stiffening structure of the adhesive to provide the flexible and resilient dividers 16 of the invention. Those who practice the invention will find that the heavy or light use of the selected adhesive will affect the stiffness of the divider 16, much as will a light or heavy application of starch to a shirt, for example. Further and depending upon the characteristics of the fabric 28 or the substrate 40 that is chosen, one may also find that a single layer of only a fabric 28 or of only a substrate 40 will provide the desired flexible divider 16.

The dividers 16 may be assembled with the divider insert 30 by extending the individual tabs 44 through a selected row of three slots 36 and either gluing or sewing the tabs 44 against the back face 50 of the divider insert 30 (FIGS. 1–7). With the dividers 16 so assembled with the divider insert 30, the tabs 34 extending from the central rectangular portion 32 of the divider insert 30 are folded generally upward and the insert 30 is placed in the interior cavity 18 of the bottom portion 12 of the case 10.

In use, a single tie is folded to fit the length of the case 10 and placed under one of the plurality of dividers 16, up to a maximum of five ties for the case that is specifically described above (FIG. 1). The case 10 is closed and may be conveniently packed in one's suitcase or briefcase or the like. Other features which may be included with the case 10 are a clasp means to hold the case 10 in a closed position. The clasp means may include a latch that extends across and holds the top and bottom portions 12 and 14 together on a side 52 of the case 10 that is opposite the hinge, a spring-loaded hinge that holds the case 10 in either of an open position or a closed position, and a belt or tie member that surrounds the case 10 and ties the case 10 closed, for example.

While the preceding description has been directed to a tie case (FIGS. 1–6), the case 10 may also be used to transport scarves (FIG. 7), or other clothing accessories of a similar nature to scarves and ties, which are to be protected from wrinkling or crumpling during transportation. Further, as is shown in the alternative embodiment of FIG. 7, the case 10 may include the additional features of fasteners 54 to secure necklaces and the like. A ring or earring holder 56 and a pouch 58 may also be included features of the case 10.

Figure 8:
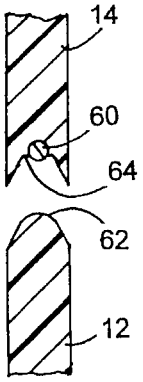
FIG. 8 is a fragmentary cross-sectional view along an edge of a case according to the invention, showing an optional case seal.

The case 10 may also be adapted to provide a higher level of security and protection to the contents by including a seal 60 (FIG. 8) between the top portion 14 and the bottom portion 12 of the case 10. The top edge 62 of the perimeter sidewalls 22 of the bottom portion 12 of the case 10 may preferably be tapered with a flat to convex terminal edge 62. The cooperating lower edge 64 of the top portion 14 is preferably formed with a corresponding concave edge surface 64. Depending upon the specific configurations of the cooperating edges 62 and 64 of the bottom portion 12 and the top portion 14, respectively, one or the other of the edges may be provided with a seal seat to receive a gasket seal 60 or the like to tightly seal the bottom portion 12 and the top portion 14 together and further protect the contents of the case 10.

Figure 9:
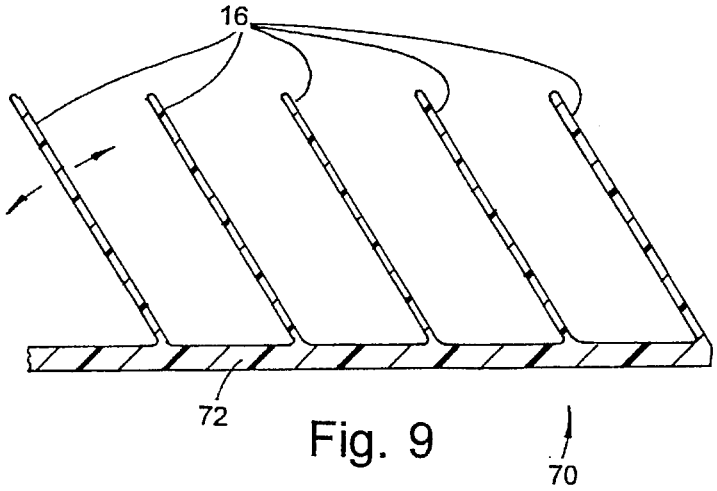
FIG. 9 is the view of FIG. 3, showing a fragmentary cross-sectional view of an alternative divider inset.

As a further modification that is particularly suited for a commercial application of the case 10, the dividers 16 and divider insert 30 may be a length cut from a one-piece extruded member 70 (FIG. 9). The one-piece extrusion may be formed of a polyvinylchloride plastic, high impact polystyrene, or other suitable material and include a thin base plate 72 from which a plurality of integrally formed dividers 16 extend outward, to one side of the base plate 70. As is known in extrusion technology, the one-piece extruded member 70 may be formed with a textured surface to hold the contents of the case in place. The one-piece extruded member 70 may also be covered with the protective fabric cover 28 as is discussed in greater detail above.

It will be understood by those who practice the invention and by those skilled in the art, that various modifications and improvement may be made to the invention without departing from the spirit of the disclosed concept. The scope of protection afforded is to be determined by the claims and by the breadth of interpretation allowed by law.

The embodiments of the invention in which an exclusive property or privilege is claimed are defined as follows.

1. A clothing accessories case comprising:

a bottom portion with an interior cavity that is accessible from outside said bottom portion, said bottom portion having an interior bottom surface;

a cooperating top portion that abuts said bottom portion to define a closed case that encloses said interior cavity; and a plurality of flexible dividers that are located in said interior cavity and affixed to said bottom surface along locations that are laterally offset from one another, said plurality of dividers being oriented generally parallel with one another, said dividers having sufficient flexibility so as to not function as a press.

2. The case defined in claim 1, wherein said dividers are resilient to be deflected from an initial position and return to the initial position.

3. The case defined in claim 2, wherein each divider of said plurality of dividers is hingedly connected with said bottom portion.

4. The case defined in claim 3, wherein said interior cavity has a length and each divider of said plurality of dividers extends generally along at least a portion of said length.

5. The case defined in claim 4, wherein each divider of said plurality of dividers includes a structural substrate and a finish covering that is attached to and substantially encapsulates said structural substrate.

6. The case defined in claim 5, wherein said finish covering extends significantly beyond said structural substrate in at least one direction.

7. The case defined in claim 6, further including a seal that is interposed between said bottom portion and said top portion.

8. The case defined in claim 1, wherein each divider of said plurality of dividers includes a structural substrate and a finish covering that is attached to and substantially encapsulates said structural substrate, said structural substrate being resilient to be deflected from an initial position and return to the initial position.

9. A tie and scarf case comprising:

a bottom portion with an open top and an interior cavity that is accessible through said open top and has a length, said bottom portion having an interior bottom surface;

a cooperating top portion that is adapted to cover said open top and abuts said bottom portion to define a closed case that encloses said interior cavity; and a plurality of resilient, flexible dividers that are located in said interior cavity, connected with said bottom surface at offset intervals, oriented generally parallel with one another, and resilient to be deflected from an initial position and return to the initial position, each divider of said plurality of dividers extending generally along at least a portion of said length and having sufficient flexibility so as to not function as a press.

10. The case defined in claim 9, wherein each divider of said plurality of dividers is hingedly connected with said bottom portion.

11. The case defined in claim 9, wherein each divider of said plurality of dividers includes a structural substrate and a finish covering that is attached to and substantially encapsulates said structural substrate.

12. The case defined in claim 11, wherein said finish covering extends significantly beyond said structural substrate in at least one direction.

13. The case defined in claim 9, further including a seal that is interposed between said bottom portion and said top portion.

14. The case defined in claim 13, wherein said seal provides air tight closure of said interior cavity.

15. A clothing accessories case comprising:

a bottom portion with an interior cavity that is accessible from outside said bottom portion, said bottom portion having an interior bottom surface;

a cooperating top portion that abuts said bottom portion to define a closed case that encloses said interior cavity;

a seal that is interposed between said bottom portion and said top portion; and a plurality of flexible dividers that are located in said interior cavity and hingedly connected to said bottom surface by a plurality of laterally offset hinges, said plurality of dividers being oriented generally parallel with one another and having sufficient flexibility so as to not function as a press.

16. The case defined in claim 15, wherein said dividers are resilient to be deflected from an initial position and return to the initial position.

17. The case defined in claim 16, wherein each divider of said plurality of dividers is hingedly connected with said bottom portion.

18. The case defined in claim 17, wherein said interior cavity has a length and each divider of said plurality of dividers extends generally along at least a portion of said length.

19. The case defined in claim 18, wherein each divider of said plurality of dividers includes a structural substrate and a finish covering that is attached to and substantially encapsulates said structural substrate.

20. The case defined in claim 19, wherein said finish covering extends significantly beyond said structural substrate in at least one direction.

21. The case defined in claim 20, wherein said seal provides air tight closure of said interior cavity.

22. The case defined in claim 15, wherein each divider of said plurality of dividers includes a structural substrate and a finish covering that is attached to and substantially encapsulates said structural substrate, said structural substrate being resilient to be deflected from an initial position and return to the initial position.

23. The case defined in claim 15, wherein said seal provides air tight closure of said interior cavity.

* * * * *

UNITED STATES PATENT AND TRADEMARK OFFICE

CERTIFICATE OF CORRECTION

PATENT NO. : 5,560,483
DATED : October 1, 1996
INVENTOR : Dennis A. Seguin

It is certified that error appears in the above-identified patent and that said Letters Patent is hereby corrected as shown below:

On title page, items [19] and [76], "Sequin" should read --Seguin--

Column 2, line 3;

"111-111" should be –III-III–.

Column 2, line 21;

"inset" should be –insert–.

Column 2, line 31;

"potion" should be –portion–.

Column 2, line 33;

"potion" should be –portion–.

UNITED STATES PATENT AND TRADEMARK OFFICE

CERTIFICATE OF CORRECTION

PATENT NO. : 5,560,483
DATED : October 1, 1996
INVENTOR : Dennis A. Seguin

It is certified that error appears in the above-identified patent and that said Letters Patent is hereby corrected as shown below:

Column 2, line 39;

"potion" should be –portion–.

Column 2, line 50;

"potion" should be –portion–.

Column 4, line 48;

"fiat" should be –flat–.

Column 5, line 6;

"improvement" should be –improvements–.

Signed and Sealed this

Twenty-fifth Day of February, 1997

*Attest:*

Bruce Lehman

BRUCE LEHMAN

*Attesting Officer*

*Commissioner of Patents and Trademarks*